United States Patent [19]

Oshikubo et al.

[11] 4,261,205

[45] Apr. 14, 1981

[54] PIPETTING DEVICE

[75] Inventors: Yuji Oshikubo, Sakura; Saijiro Suzuki, Tokyo, both of Japan

[73] Assignee: Nichiryo Co., Ltd, Tokyo, Japan

[21] Appl. No.: 81,151

[22] Filed: Oct. 2, 1979

[51] Int. Cl.[3] ..... B01L 3/02

[52] U.S. Cl. ..... 73/425.6; 422/100

[58] Field of Search ..... 73/425, 4 P, 425.6; 422/100; 222/309

[56] References Cited

U.S. PATENT DOCUMENTS

| | | | |
|---|---|---|---|
| 2,792,834 | 5/1957 | Kapelsohn | 73/425.6 |
| 4,023,716 | 5/1977 | Shapiro | 73/425.6 |
| 4,084,730 | 4/1978 | Franke et al. | 73/425.6 |
| 4,117,728 | 10/1978 | Johnson | 73/425.6 |

*Primary Examiner*—S. Clement Swisher

*Attorney, Agent, or Firm*—James E. Nilles

[57] ABSTRACT

A pipetting device including a vertical cylinder provided on the lower end portion of a cylindrical housing, a piston working in the cylinder, an actuating rod connected to the piston and extending vertically through the housing, an operating knob mounted on the upper end of the actuating rod, a return spring biassing upwards the actuating rod, and a hollow tip mounted removably on the lower end of the cylinder for receiving liquid therein. The opposite ends of the return spring are connected non-rotatably to the housing and the actuating rod respectively thereby the actuating rod is biassed angularly with respect to the vertical axis thereof. The device further includes guiding mechanism for controlling the downward movement of the actuating rod in normal operating condition and allowing an additional downward movement thereof when the actuating rod is rotated angularly whereby the tip is removed off from the pipetting device.

6 Claims, 5 Drawing Figures

PIPETTING DEVICE

BACKGROUND OF THE INVENTION

This invention relates to a micro pipetting device that is adapted to dispense a small quantity of liquid samples such as reagents or the like with an exceedingly high degree of accuracy and reproducibility and, more particularly, pipetting devices of the type including a vertical cylinder provided on the lower end portion of a cylindrical housing, a piston working in the cylinder, an actuating rod connected to the piston and extending vertically through the housing, an operating knob mounted on the upper end of the actuating rod, a return spring biassing upward the actuating rod, and a tip mounted removably on the lower end of the cylinder for receiving therein and discharging therefrom liquid.

One example of the pipetting devices of the aforementioned type is disclosed in British patent specification No. 1,271,683 wherein the device is of the type including a vertical cylinder provided on the lower end portion of a coaxial cylindrical housing, a piston working in the cylinder, an actuating rod connected to the piston and extending vertically through the housing, an operating knob mounted on the upper end of the actuating rod, a return spring biassing upwards the actuating rod, and a hollow tip mounted removably on the lower end of the cylinder for receiving liquid therein and discharging liquid therefrom in operating the pipetting device. The tip has a conical shape and is snugly fitted on a frusto-conical lower end portion of the cylinder. The device can effectively restrain the contamination, however, there are shortcomings such that it is necessary to use a special apparatus in removing or mounting the tip, and that the device is not adapted to dispence a minute amount of liquid such as 10 μl or less.

BRIEF SUMMARY OF THE INVENTION

One of the objects of the present invention is to provide a pipetting device eliminating the shortcomings aforementioned.

According to the present invention, there is provided a pipetting device of the aforementioned type wherein the opposite ends of the return spring are connected non-rotatably to the housing and to the actuating rod respectively so that the actuating rod is biassed angularly with respect to the vertical axis thereof, and the pipetting device further includes guiding means for controlling the downward movement of the actuating rod in the normal operating condition and for allowing an additional downward movement of the actuating rod when the actuating rod is rotated against the angularly biassing force of the return spring.

Preferably, the tip is a small diameter cylindrical hollow tube, and the piston is a plunger with the diameter thereof being smaller than the outer diameter of the tip and being larger than the inner diameter of the tip.

Preferably, the guiding means comprises a guide sleeve which is non-rotatable and vertically slidable in the housing, a second spring for biassing the guide sleeve upward against a stop formed in the housing with the spring force being larger than that of the return spring, a pin secured to the actuating rod, a vertical groove formed in the guide sleeve for receiving therein the pin to control the downward movement of the actuating rod in the normal operating condition, and a second vertical groove spaced angularly from the first vertical groove and connected therewith for receiving therein the pin to allow the additional downward movement of the actuating rod when the actuating rod is rotated against the angularly biassing force of the return spring.

BRIEF DESCRIPTION OF THE DRAWINGS

The invention will be described, by way of example, with reference to the accompanying drawings, in which.

DETAILED DESCRIPTION OF PREFERRED EMBODIMENTS

Figure 1:
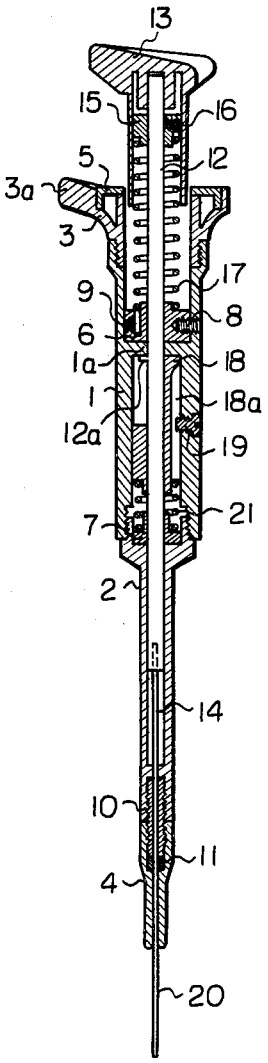
FIG. 1 is a longitudinal sectional view of a pipetting device according to the invention.

The pipetting device according to the invention illustrated in FIGS. 1–4 comprises a generally cylindrical housing consisting of an upper main body 1, a lower main body 2 connected to the upper main body 1 to extend downward therefrom, a cap 3 connected to the upper end of the upper main body 1, and a cylinder retainer 4 connected to the lower end of the lower main body 2. An actuating rod 12 extends coaxially through the upper main body 1 and is guided by spring retainers 6 and 7. The spring retainer 6 abuts with an annular wall 1*a* formed in the midway of the length of the upper main body 1, and the spring retainer 7 is located on the bottom of a counter bore which is formed in the upper end portion of the lower main body 2. An operating knob 13 is non-rotatably secured to the upper end of the actuating rod 12 and, there is provided adjacent to the operating knob 13 a spring retainer 15 cooperating with the spring retainer 6 to support therebetween a return spring 17. The spring retainer 15 is secured to the actuating rod 12 by a set screw 16. One end of the return spring 17 is bent and inserted into an axial hole formed in the spring retainer 15 and the other end thereof is similarly bent and inserted into an axial hole formed in the spring retainer 6 and is secured thereto by a set screw 9. A set screw 8 is provided to restrain the rotation of the spring retainer 6 with respect to the main body 1.

Figure 3:
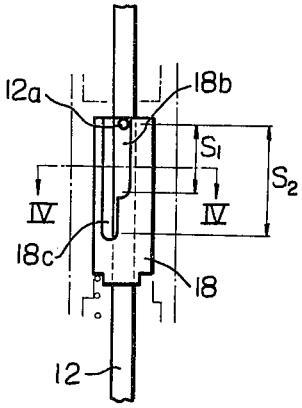
FIG. 3 is an enlarged view showing a guide sleeve incorporated in the pipetting device of FIG. 1.
Figure 4:
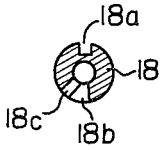
FIG. 4 is a cross-sectional view taken along line IV—IV in FIG. 3.

A cylindrical guide sleeve 18 is slidably fitted in an annular space defined in the upper main body 1 and below the annular wall 1*a*. The rotating movement of the guide sleeve 18 with respect to the main body 1 is restrained by an axial or longitudinal groove 18*a* which is formed in the outer surface of the guide sleeve 18 and is slidingly engaged by the inner end of a set screw 19 secured to the main body 1. The guide sleeve 18 further includes axial grooves 18*b* and 18*c* which are spaced angularly and connected with one another as clearly shown in FIG. 3. A transverse projecting pin 12*a* provided on the actuating rod 12 is received in either of the grooves 18*b* and 18*c*. When the pin 12*a* is received in the groove 18*b*, the actuating rod 12 can move in the axial direction by the length corresponding to the axial length of the groove 18*b*. Normally, the pin 12*a* of the actuating rod 12 takes the angular position with respect to the guide sleeve 18, according to the angular biassing force of the return spring 17, so as to engage with the groove 18*b* as shown in FIG. 3. In such condition, the relative movement of the actuating rod 12 with respect to the guide sleeve 18 is controlled by a length $S_1$ as depicted in FIG. 3. When the actuating rod 12 is rotated against the biassing force of the return spring 17, (in the clockwise direction as viewed from the upper side in FIG. 3) the pin 12*a* of the actuating rod 12 engages with the groove 18*c*, and the actuating rod 12 can move downward by a distance $S_2$ which is larger than the distance $S_1$.

A second spring 21 having the spring force larger than that of the return spring 17 is provided between the lower end of the guide sleeve 18 and the spring retainer 7 so as to bias the guide sleeve 18 against the annular wall 1*a* which acts as a stop. Thus, the actual stroke of the acuating rod 12 is larger than the aforesaid distance $S_1$ or $S_2$.

A small diameter plunger 14 preferably formed of stainless steel rod is secured to the lower end of the actuating rod 12. The plunger 14 works in a cylinder 10 which screw-threadingly engages with and is retained by the lower end of the main body 2 and the cylinder retainer 4. An O-ring 22 seals the upper end of the cylinder 10. The lower end of the cylinder 10 abuts with an annular tip retaining member 11, which has an inner diameter adapted to snugly receive therein a hollow tubular tip 20. Preferably, the outer diameter of the tip 20 is slightly larger than the diameter of the plunger 14. An O-ring 23 is provided on the lower end of the tip retaining member 11 to frictionally engage with the tip 20 and to seal the lower side of the cylinder 10. When the actuating rod 12 moves downward with the pin 12*a* thereof engaging with the groove 18*c* of the guide sleeve 18, the lower end of the plunger 14 projects downwards of the O-ring 23. The tip 20 is pushed downward by the plunger 14, whereby the upper end of the tip 20 passes through the tip retaining member 11 and the O-ring 23, and the tip 20 is removed from the device.

The length and the inner diameter of the tip 20 are determined such that the tip can receive therein a predetermined amount of liquid as defined by the inner diameter of the cylinder 10 and the stroke $S_1$ of the actuating rod 12. Further, the inner diameter of the tip 20 is smaller than the diameter of the plunger 14 so that the tip can reliably pushed by the plunger 14.

In operation, the user will grasp the pipetting device with the main body 1 held in the hand so that the operating knob 13 can be operated by the thumb. As the knob 13 is depressed against the spring force of the return spring 17 and thereafter released so as to reciprocate the plunger 14 by the distance $S_1$, a predetermined amount of liquid is sucked from such as a sample solution into the tip 20. It will be noted that the pin 12*a* of the actuating rod normally engages with the groove 18*b* according to the angularly biassing force of the return spring 17. The tip 20 is introduced into a receiving vessel and the operating knob 13 is depressed against the spring force of the return spring 17 and, thereafter, against the spring force of the second spring 21 so that the plunger 14 moves by the distance $S_1$ plus an additional distance which is defined by the downward movement of the guide sleeve 18. The liquid sucked in the tip 20 can throughly be discharged. At that condition, the lower end of the plunger 14 does not project from the lower end of the cylinder 10.

Figure 2:
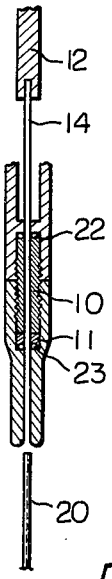
FIG. 2 is an enlarged view showing the lower end portion of FIG. 1.

For removing the tip 20 from the device, the operating knob 13 is rotated in the clockwise direction by the thumb against the angularly biassing force of the return spring 17 and, thereafter, the operating knob 13 is depressed. The pin 12*a* of the actuating rod 12 moves along the groove 18*c* and, thereafter, displaces the guide sleeve 18 against the second spring 21. The lower end of the plunger 14 displaces downward the tip 20 so that the upper end thereof separates from the O-ring 23. The tip 20 drops out of the lower end of the cylinder retainer 4. It will be noted that there is formed a vertical bore in the lower portion of the cylinder retainer 4 as shown in FIGS. 1 and 2, but the diameter of which is slightly larger than the outer diameter of the tip 20 so that the tip 20 will freely drops when the upper end thereof is separated from the O-ring 23. The bore acts to guide the tip 20 in inserting the tip into the tip retaining member 11 and also to reliably retain the tip in the tip retaining member 11. For easily rotating the operating knob 13 by the thumb, there is formed a recess in the upper surface of the knob 13 and, further, a projection 3*a* is formed on the cap 3 for easily grasping the device at a suitable angular position. If desired, a mark and an index (not shown) are provided on a cover 5 and downwardly extending lower end portion of the knob 13 for indicating the angular position of the knob 13 with respect to the main body 1.

Figure 5:
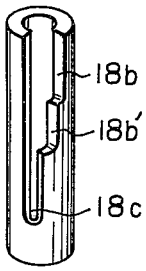
FIG. 5 is a perspective view of a modified guide sleeve.

FIG. 5 shows a modified form of the guide sleeve 18 wherein a groove 18*b*′ is formed in addition to the groove 18*b* of the first embodiment. The pipetting device incorporating the guide sleeve of FIG. 5 can selectively dispense either of two predetermined amounts of liquid which are defined by the grooves 18*b* and 18*b*′, respectively.

As described heretofore, the pipetting device according to the invention enables to perform very easily the tip exchanging operation, to eliminate cross-contamination or other contamination of the liquid samples dispensed, and to dispense desired definite small quantities of liquid and, further, the device is simple in construction, and easy and reliable in operation.

What is claimed is:

1. A pipetting device of the type including a vertical cylinder provided on the lower end portion of a cylindrical housing and co-axially therewith, a piston working in the cylinder, an actuating rod connected to the upper end of the piston and extending through the housing, an operating knob mounted on the upper end of the actuating rod, and a return spring biassing upwards the actuating rod, characterized in that one end of said return spring is non-rotatably connected to the housing and the other end thereof non-rotatably to the actuating rod thereby the actuating rod is angularly biassed with respect to the vertical axis thereof, that the device comprises guiding means for controlling the downward movement of the actuating rod in normal operating condition and allowing an additional downward movement of the actuating rod when the actuating rod is rotated against angularly biassing force of the return spring, and that a hollow tip for receiving liquid therein is removably mounted on the lower end of the cylinder, said tip being removed off from the device when the actuating rod additionally moves downward.

2. A pipetting device as set forth in claim 1 wherein the lower end of the piston is adapted to project out of the cylinder when the actuating rod additionally moves downward, whereby the tip is pushed downward by the piston.

3. A pipetting device as set forth in claim 2 wherein said tip is a small diameter cylindrical hollow tube, and the piston is a plunger with the diameter thereof being smaller than the outer diameter of the tip.

4. A pipetting device as set forth in claim 3 wherein the diameter of the plunger is larger than the inner diameter of the tip.

5. A pipetting device as set forth in claim 2 wherein said guiding means comprises a guide sleeve being vertically slidable in the housing, a second spring for biassing the guide sleeve upward against a stop formed in the housing with the spring force being larger than that of the return spring, a pin secured to the actuating rod, a first vertical groove formed in the guide sleeve for receiving therein the pin to control the downward movement of the actuating rod in normal operating condition, and a second vertical groove formed in the guide sleeve for receiving therein the pin to allow said additional downward movement of said actuating rod, said second groove being spaced angularly from said first groove and communicating therewith.

6. A pipetting device as set forth in claim 5 wherein said second groove is connected with the first groove over the substantial portion of the latter.

* * * * *